United States Patent [19]

Schwarz

[11] Patent Number: 4,620,555

[45] Date of Patent: Nov. 4, 1986

[54] CIGARETTE DISPENSER

[76] Inventor: Eitan D. Schwarz, 988 Oak Dr., Glencoe, Ill. 60022

[21] Appl. No.: 540,680

[22] Filed: Oct. 11, 1983

[51] Int. Cl.[4] ..... A24F 15/00

[52] U.S. Cl. ..... 131/270; 131/329

[58] Field of Search ..... 131/270, 329; 434/365; 221/3

[56] References Cited

U.S. PATENT DOCUMENTS

| | | | |
|---|---|---|---|
| 580,736 | 4/1897 | Smith | 131/329 |
| 2,016,534 | 10/1935 | Blackwell | 131/329 |
| 2,415,911 | 2/1947 | Rubane | 131/329 |
| 2,456,936 | 12/1948 | Leatherman | 131/329 |
| 2,554,360 | 5/1951 | Davis | 131/270 |
| 2,613,529 | 10/1952 | Harris | 131/270 |
| 2,618,956 | 11/1952 | Hanna | 131/270 |
| 2,675,693 | 4/1954 | Emery | 131/270 |
| 2,681,560 | 6/1954 | Shuttleworth et al. | 131/270 |
| 2,812,851 | 11/1957 | Kinnebrew | 131/270 |
| 2,951,357 | 9/1960 | Geraghty | 131/270 |
| 2,953,280 | 9/1960 | Scarboro | 131/270 |
| 3,017,763 | 1/1962 | Weil | 131/270 |
| 3,030,795 | 4/1962 | Vogt | 131/270 |
| 3,206,957 | 9/1965 | Reitzes | 131/270 |
| 3,363,439 | 1/1960 | Kende | 131/329 |
| 3,424,123 | 1/1969 | Giffard | 131/270 |
| 3,655,325 | 4/1972 | Toppel | 131/270 |
| 3,660,998 | 5/1972 | Ishijima | 131/329 |
| 3,722,742 | 3/1973 | Wertz | 131/329 |
| 3,750,435 | 8/1973 | Belkin | 131/329 |
| 3,815,780 | 6/1974 | Bauer | 131/329 |
| 4,037,719 | 7/1977 | Perimutter | 131/270 |
| 4,084,415 | 4/1978 | Corman | 131/270 |
| 4,223,801 | 9/1980 | Carlson | 221/3 |

*Primary Examiner*—Vincent Millin

*Attorney, Agent, or Firm*—Emrich & Dithmar

[57] ABSTRACT

A cigarette dispenser provides user access to cigarettes therein only after a user preset time interval to permit the user to later reconsider the decision to smoke and allow the initial urge for a cigarette to subside. A manually selected switch on the dispenser is engaged by the user when a cigarette is desired and is coupled to and triggers a timer preset to a predetermined time interval. A latch mechanism coupled to an audio alarm prevents the dispenser from being opened prior to running and expiration of the predetermined time interval without an embarrassing, user nondefeatable sound being emitted. Means are provided within the dispenser for changing the length of the predetermined time interval when the dispenser is open. A visual signal is provided to indicate when the predetermined time interval has expired and the dispenser may be opened without sounding the alarm. Various other timers measure a second time period during which an embarrassing alarm sounds when the lid is opened in an unauthorized manner and how long the dispenser is open and trigger the audio alarm if the dispenser is open longer than a third predetermined time period. Counters count the total number of times the dispenser is opened, the number of times the dispenser was not opened following countdown of the predetermined time interval, the number of times the dispenser was opened without setting or waiting for the running of the predetermined time interval, and maintain running totals of these numbers.

15 Claims, 4 Drawing Figures

CIGARETTE DISPENSER

BACKGROUND OF THE INVENTION

This invention relates generally to cigarette cases for holding a quantity of cigarettes and is particularly directed to a cigarette dispenser which provides limited access to cigarettes stored therein for the purpose of reducing a smoker's consumption of cigarettes.

The physical hazards of cigarette smoking are well known and their consumption discouraged by health authorities. The reduction of cigarette smoking is desirable in itself because it is well-known that the damage due to cigarette smoking is cumulative and dose related. In addition to the danger of fire associated with smoking, medical authorities have shown beyond doubt that there is a greater incidence of heart, lung and throat ailments including cancer among smokers than among non-smokers. In addition, non-smokers who are in the vicinity of a cigarette smoker are exposed to the irritation and possible health hazard of the smoke thus produced. Furthermore, smoking can be a costly habit particularly in the case of a heavy smoker. Thus, ever increasing numbers of smokers have undertaken efforts to reduce, if not to completely stop, cigarette consumption.

Attempts at giving up the cigarette smoking habit have ranged from the use of deterrent drugs to professional counseling and even to hypnosis. These various approaches have, in general, all suffered from various shortcomings. Individual professional and group counselling have met with varying degrees of success, although the former is frequently expensive and the latter frequently inconvenient, requiring time consuming travel and attendance at meetings. In addition, mass communications campaigns sponsored by the government and various nonprofit organizations have attempted to bring the dangers of smoking to the attention of the general public with limited success. Finally, hypnosis is relied upon as an anti-smoking aid, however, its nature discourages many smokers from attempting this approach and it has led to somewhat inconclusive long term results. Hypnosis and other treatment programs are episodic and not directly available to the smoker at each moment of decision to light up.

Other anti-smoking efforts have centered not so much on the individual, but rather on a device for discouraging or inhibiting smoking. Such devices frequently include a cigarette container having a time controlled locking mechanism which provides the smoker with access to the cigarettes only at predetermined times. The use of such devices is based upon the theory that the cigarette smoking habit can best be terminated, or at least controlled, by a gradual withdrawal rather than completely stopping all at once. According to this approach, the craving for cigarettes will gradually subside until it is lost completely. This type of device, however, confronts the smoker with a cigarette abstinence situation, at least temporarily, and frequently proves too much, particularly for the high rate smoker who then circumvents the system by acquiring another source of cigarettes. Thus, after an initial period of use, this type of device is typically discarded by the smoker who is unable to accept and deal with the complete denial, albeit temporary in nature, of access to a cigarette.

The present invention is intended to overcome the limitations of the prior art by providing a device which operates directly and repeatedly at each moment of decision to smoke a cigarette by forcing the smoker to reconsider his decision following the initial urge to smoke by temporarily delaying access to each cigarette while providing the smoker with up-to-date information regarding past cigarette consumption. The present invention does not compel the smoker to quit altogether, but rather allows him/her to control the pace of his/her withdrawal according to individual needs and lessens the possibility of complete discouragement and the giving up of the effort to stop smoking. Access to cigarettes is not completely barred as in other smoking inhibiting devices so as to reduce the incentive of the smoker to circumvent the device by buying more cigarettes and thus giving up on trying to kick the habit.

OBJECTS AND SUMMARY OF THE INVENTION

Accordingly, it is an object of the present invention to assist a smoker in reducing the number of cigarettes consumed.

It is another object of the present invention to provide a cigarette dispenser for limiting smoker access to cigarettes stored therein to predetermined time periods established by the smoker.

Yet another object of the present invention is to provide a cigarette dispenser which limits smoker access to cigarettes therein to predetermined time periods and provides an audio alarm when the smoker attempts to gain unauthorized access and a visual indication of when access is authorized.

Still another object of the present invention is to provide a device for limiting access to cigarettes contained therein to predetemined time periods in which cigarette access may be gained by the smoker only after waiting a designated resettable time interval.

A further object of the present invention is to provide a limited access cigarette dispenser which is easy to use and inexpensive to make.

Another object of the present invention is to discourage cigarette smoking by providing a smoker with access to cigarettes only after the initial urge to smoke has subsided and the smoker has had an opportunity to reconsider.

A still further object of the present invention is to provide a smoker with information regarding his past cigarette consumption so as to discourage continued cigarette usage.

The present invention contemplates a cigarette dispenser including a generally rectangular case having a hinged lid and latch for closing the dispenser. A limit switch which couples the lid to the case actuates a speaker alarm if the lid is opened while the dispenser is in a default mode when cigarette access is unauthorized. When the user desires authorized access to a cigarette, he engages a manual switch on the outside of the dispenser for initiating countdown of a first timer. The first countdown timer, which is preset and resettable by a user-actuated switch within the dispenser, is coupled to the limit switch for deactivating the limit switch and alarm for predetermined periods following expiration of the countdown interval during which authorized cigarette access may be gained for a short interval.

Following completion of the first timer countdown, a visual indication is provided that the dispenser is in the authorized access mode, that the alarm circuit is disengaged, and that the dispenser may be opened. If the dispenser is opened in an unauthorized manner without prior running and expiration of the countdown timer and interval, an audio alarm timed by a second timer is triggered and emits an embarrassing sound for a predetermined second period of time. The length of the second period is set to cause user embarrassment sufficient to discourage unauthorized lid openings, and the alarm is not user defeatable. Event counters for counting authorized and unauthorized lid openings as well as the number of times the lid was not opened, i.e., a cigarette was skipped, following expiration of the first countdown is provided.

When the dispenser is opened following the countdown interval, a third timer is triggered for counting a third period. If the dispenser is not closed by the end of this third period, an audio alarm is triggered to encourage the user to close the dispenser. The length of the third period is set to permit the removal of, for example, one cigarette from the dispenser. A manual switch within the dispenser permits the user to preset and reset the first countdown period for awaiting authorized access to a cigarette. Thus, the user may give himself more or less time to wait and reconsider his initial decision to smoke a cigarette ahead of time but cannot reset this time at the moment he wants a cigarette. The first timer resets itself automatically to the prior interval unless the user resets it.

During the first countdown period various visual messages are provided to the user by means of an LCD or LED display on the dispenser. These messages are intended to discourage the smoking of the next cigarette and include such information as the total number of times the dispenser has been opened to remove a cigarette, the number of times the timer has counted down and the dispenser has not been opened and the number of times the dispenser has been opened while in authorized and unauthorized access modes. Logic circuitry is provided for determining the optimal countdown period for user rejection of the next cigarette for an individual user based upon past usage. In addition, various audio warnings, including synthesized voice messages, may be provided during this timer countdown interval to further discourage the removal of a cigarette from the dispenser.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENTS

Figure 1:
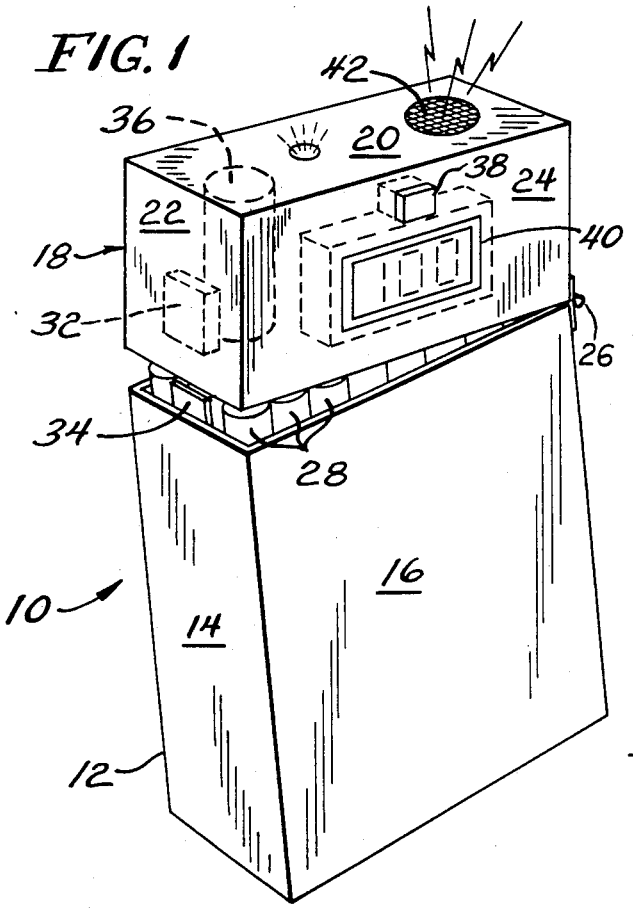
FIG. 1 is a perspective view of a cigarette dispenser in accordance with the present invention.
Figure 2:
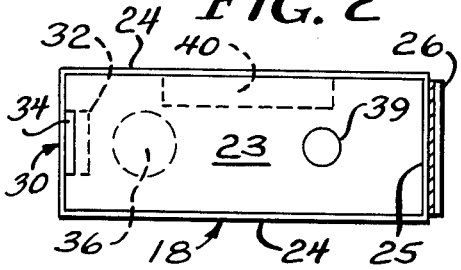
FIG. 2 is a view of a lower portion of the lid of the cigarette dispenser shown in FIG. 1.
Figure 3:
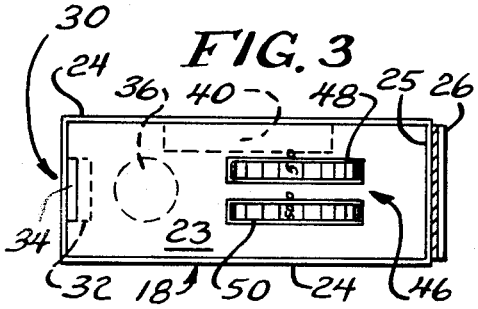
FIG. 3 shows another embodiment of the lower portion of the lid of the cigarette dispenser shown in FIG. 1.

Referring to FIGS. 1, 2 and 3, there are shown various views of a cigarette dispenser 10 in accordance with the present invention.

The cigarette dispenser 10 includes a generally rectangular, elongated case 12 made preferably of a molded hard plastic, which includes a front wall 14, a rear wall (not shown), side walls 16, and a lower wall (not shown). The various walls forming case 12 are coupled so as to form an enclosure into which a conventional pack of cigarettes 28 may be placed. The upper end portion of the case 12 thus formed by the various aforementioned walls is open and mounted thereto by means of a hinge 26 is a lid 18. Lid 18 similarly is comprised of a front wall 22, a lower wall 23, side walls 24, and a rear wall 25. The lower wall 23 of lid 18 is recessed from the lower edge of the lateral walls of the lid so as to provide clearance for the upper end portions of cigarettes 28 positioned within case 12 when the lid is in a closed position.

Positioned on a front portion of the cigarette dispenser 10 is a limit switch 30 which includes a latch mechanism 32 coupled to the inner portion of the lid's front wall 22 and a clasp 34 mounted to the inner surface of the front wall 14 of case 16. Latch mechanism 32 engages clasp 34 when the lid 18 is in the closed position. It is contemplated that the combination of latch mechanism 32 and clasp 34 may make use of conventional components and be of conventional design. For example, the engagement of the latch mechanism 32 with the clasp 34 may be purely mechanical in nature or may be in the nature of an electromechanical engaging force. Whatever the mechanical design of the combination of latch mechanism 32 and clasp 34, the limit switch 30 which they comprise is electrically actuated as explained below.

Also located within lid 18 in the upper wall 20 thereof is a speaker 42. Opening of the cigarette dispenser 10 causes the limit switch 30 to close thus activating speaker 42 which emits an audio alarm in order to discourage the user from opening the cigarette dispenser during unauthorized periods. The emission of an embarrassing sound from speaker 42 is intended to further discourage the user from opening the cigarette dispenser at unauthorized times. The duration of the alarm sound is determined by a timer circuit and is not user defeatable. A display, such as a light emitting diode (LED) or liquid crystal diode (LCD) display, 40 positioned on an outer surface of the cigarette dispenser 10 provides a visual indication of when the cigarette dispenser 10 may be opened in an authorized manner in accordance with timing information it is programmed with. Opening of the cigarette dispenser 10 when the display 40 is not illuminated will similarly result in an audio alarm being emitted from speaker 42.

Also located on lid 18 is a pushbutton switch 38 which permits the cigarette dispenser 10 to be opened without sounding the aforementioned audio alarm. When the pushbutton switch 38 is engaged, a delay timer (described below) is actuated for counting down a predetermined time period. Upon expiration of this timer countdown delay, the display 40 is illuminated signalling to the user that the cigarette dispenser 10 may be opened without sounding the audio alarm. The same timer circuit will trigger the audio alarm from speaker 42 if the limit switch 30 is not engaged within a predetermined time period following the opening of lid 18. This permits the user to open the cigarette dispenser only for a short period, e.g., long enough to permit the removal of a single cigarette, before the audio alarm is automatically triggered. Once speaker 42 is thus actuated, it cannot be defeated and the audio alarm will sound for a predetermined time period.

Also positioned within the lid 18 is a conventional dry cell storage battery 36 for energizing the various circuitry, alarms and displays of the present invention. Battery 36 provides a DC voltage source for energizing the electrical circuitry of the cigarette dispenser 10 which is described below.

Figure 4:
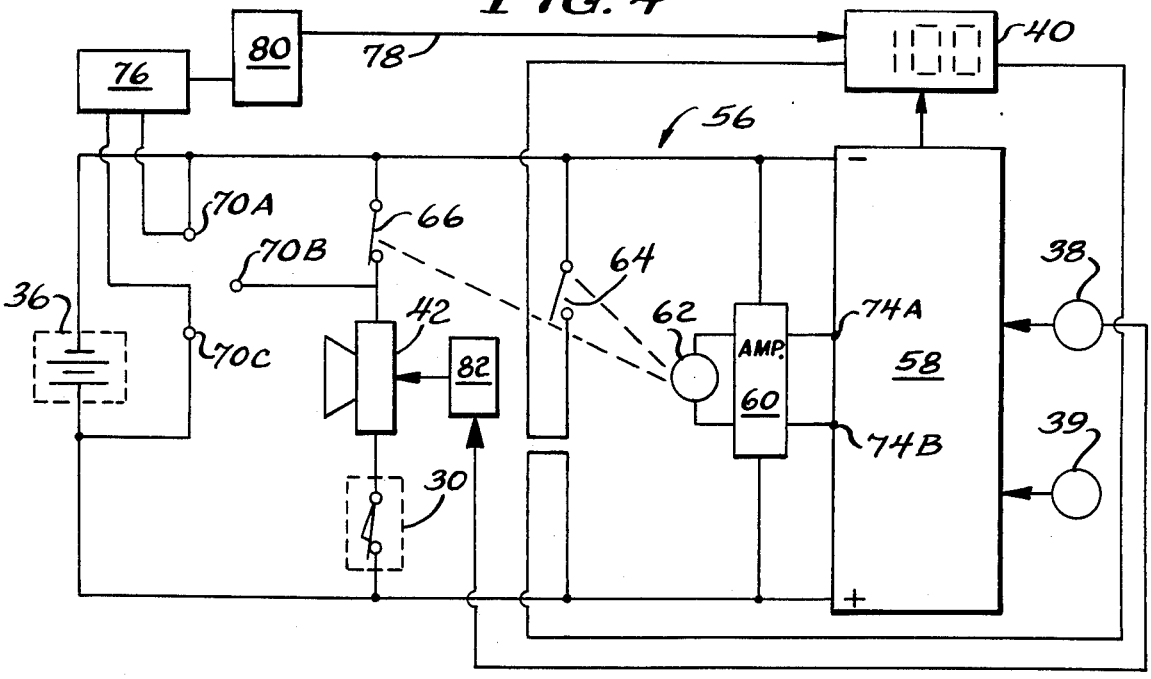
FIG. 4 shows partially in block diagram form and partially in schematic diagram form an electrical circuit for use in the cigarette dispenser of the present invention.

In addition to providing a visual indication of when the cigarette dispenser 10 may be opened without actuating speaker 42, the display 40 is coupled to an event counter 76 shown in FIG. 4 for displaying such information as the number of times the cigarette dispenser has been opened to remove a cigarette, the number of times the delay timer counted down to zero and the dispenser was not opened, the number of times the dispenser 10 has been opened without setting of and/or prior to expiration of the timer countdown and the time remaining in the timer countdown period. Details regarding how these various numbers are generated and displayed are provided in the following paragraphs.

Referring to FIG. 2, there is shown the lower wall 23 of lid 18. Positioned in the lower wall 23 is a pushbutton switch 39 by means of which the user may set the predetermined first countdown time interval between selection of switch 38 following the initial decision to smoke a cigarette and when the cigarette dispenser 10 may be opened in an authorized manner without actuating speaker 42 and triggering the audio alarm. For example, each engagement of pushbutton switch 39 may increase the first countdown period by a predetermined time increment. Continued actuation of pushbutton switch 39 would cause a predetermined maximum time to be exceeded whereupon the timer would roll-over to a predetermined minimum time whereupon the selected time interval would again increase with continued engagement of switch 39. Such arrangements are well known to those skilled in the art.

Referring to FIG. 3, there is shown another arrangement for presetting the desired time interval between the selection of switch 38 and when the cigarette dispenser 10 may be opened without actuating speaker 42 and triggering the audio alarm. This arrangement of the present invention includes a timer control 46 comprised of two rotary dials 48, 50, each of which is in the form of a thumbwheel. In a preferred embodiment, rotary dial 48 is calibrated in one minute increments, up to ten minutes, while rotary dial 50 is calibrated in ten minute increments up to fifty minutes. Thus, by manually setting in a selected time period on timer control 46, the user may fix the length of time between the selection of switch 38 and when the display 40 is illuminated indicating that the cigarette dispenser 10 may be opened without actuating speaker 42. It is to be noted that in the embodiment shown in FIG. 2 as well as that shown in FIG. 3, the time between the decision to smoke a cigarette and when authorized access to a cigarette is provided without triggering an audio alarm may be set, or changed, by the user only if lid 18 is in an open position. This insures that the user may not circumvent the timing sequence of the cigarette dispenser 10 in order to gain unauthorized access to the cigarettes therein.

Referring to FIG. 4, there is shown in simplified schematic and block diagram form a control circuit 56 for use in the cigarette dispenser 10 of the present invention. The operation and configuration of the control circuit 56 shown in FIG. 4 will now be explained with respect to the various components of the cigarette dispenser 10 shown in FIGS. 1, 2 and 3.

The control circuit 56 is energized by a DC voltage source in the form of a dry cell battery 36. Battery 36 is coupled across the positive and negative terminals of a timer circuit 58. Timer circuit 58 is a conventional countdown timer, the timing period of which may be established by means of a pushbutton switch 39, or in an alternate embodiment in the form of timer control 46, as previously described. Once timer circuit 58 is thus programmed, its contents are then provided to the digital display 40 for displaying this information thereon. The MM5865 Universal Timer available from National Semiconductor Corporation of Santa Clara, California may be used in the present invention for timer circuit 58.

While the invention is in the default or unauthorized access mode, the cigarette dispenser 10 is closed, second switch 66 is closed, and limit switch 30 which is in series with speaker 42 and second switch 66 is open. When the cigarette dispenser 10 is opened in an unauthorized manner, switch 30 will be closed resulting in the actuation of speaker 42.

Authorized access is gained in the following manner: If the second switch 66 is open speaker 42 will not be actuated whether switch 30 is in the open or closed position. Following the initiation by the selection of pushbutton switch 39 of the countdown of the pre-set time interval by timer circuit 58 and completion of the countdown interval, a signal appears across its output terminals 74A, 74B and is provided to amplifier 60. Amplifier 60, in turn, amplifies the timed output from timer circuit 58 and provides the thus amplified signal across relay coil 62 which is inductively coupled to a first switch 64 and a second switch 66. The first switch 64, which is normally open, is closed upon receipt of the output from relay coil 62 for turning on display 40 in providing a visual indication that the cigarette dispenser 10 may be opened in an authorized manner in accordance with the programmed timing information in timer circuit 58. The second switch 66, which is normally closed, opens in response to an output from relay coil 62 at the same time that the first switch 64 is closed. The opening of the second switch 66 results in the deenergization of speaker 42 so as to preclude the emission of an audio alarm therefrom upon opening of the cigarette dispenser 10. Following the countdown of timer circuit 58, expiration of the predetermined time interval determined by a preset value in timer circuit 58, timer 58 is automatically reset to its preset time and the voltage applied across output terminals 74A and 74B is removed. This results in the deactivation, or disengagement, of switch 64 and the turning off of display 40. In addition, switch 66 is again placed in the closed position so as to energize speaker 42 and activate limit switch 30. This arrangement reestablishes the limited access default mode of operation of the oigarette dispenser 10.

Also provided for in control circuit 56 are various terminals 70A, 70B and 70C. Various additional conventional components may be easily incorporated in the control circuit 56 so as to provide additional features in the cigarette dispenser 10 of the present invention. For example, an event counter 76 may be coupled across terminals 70A and 70C for counting such occurrences as the number of times that limit switch 30 is opened for withdrawal of a cigarette from the cigarette dispenser 10, the number of times timer circuit 58 counts down to zero and the cigarette dispenser 10 is not opened, the number of times timer circuit 58 counts down to zero and the cigarette dispenser 10 is opened, and the number of times the cigarette dispenser 10 is opened without actuation of timer circuit 58 and/or prior to expiration of timer circuit 58 countdown. The display of the various aforementioned user smoking characteristics is accomplished by means of a logic and display driver circuit 80 coupling the event counter 76 to display 40. These values could also be provided on display 40 by coupling the counter 76 to the digital display 40 via line 78. Such logic and display driver circuits are well known to those skilled in the art. As such, the details of the logic and display driver circuit 80 are not further described herein as they do not form a part of the present invention.

The present invention also contemplates the use of an audio device 82 such as a voice synthesizer or recorder coupled to speaker 42 for driving speaker 42 during the time period between the selection of pushbutton switch 38 following the decision to smoke and when the cigarette dispenser 10 may be opened without sounding the audio alarm. Audio device 82 may be programmed with various warnings regarding the dangers of smoking which are provided to speaker 42 to further discourage the user from smoking a cigarette after the initial urge to smoke occurs and he has initiated the process to gain authorized access to cigarettes within dispenser 10. The present invention is not limited to the counting and display of the aforementioned numbers, but is capable of measuring and displaying other parameters relating to the smoking habits of a user of the cigarette dispenser 10.

There has thus been shown a cigarette dispenser which provides authorized user access to cigarettes therein only after a predetermined time interval following the user's initial decision to smoke a cigarette. This predetermined interval, the length of which may be selected by the user, provides the user with an opportunity to reconsider and reject the next cigarette. During this period various information is provided to the user by the cigarette dispenser to discourage him from satisfying his urge to smoke.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A cigarette dispenser comprising:

a rectangularly-shaped case having an open end for receiving and storing a plurality of cigarettes;

a lid pivotally coupled to said case adjacent the open end thereof for enclosing said cigarettes within said case;

latch means coupled to said case and to said lid for sensing when said lid is in a closed position;

alarm means coupled to said latch means and responsive to the state of said latch means for generating an audio signal when said latch means is opened;

first user selectable switch means;

first timer means coupled to said first switch means and responsive to the selection of said first switch means for initiating the countdown of a first time period and for generating an output signal following said countdown; and override means coupled to said alarm means and to said first timer means and responsive to said output signal for defeating said alarm means and eliminating said audio signal if said latch means is opened following the countdown of said first time period.

2. A cigarette dispenser in accordance with claim 1 wherein said first timer means is programmable and said cigarette dispenser further includes user responsive control means coupled to said first timer means for establishing the length of said first time period.

3. A cigarette dispenser in accordance with claim 2 wherein said control means is positioned on said lid and is located within said dispenser when closed.

4. A cigarette dispenser in accordance with claim 3 wherein said control means includes first and second rotary dials for respectivly setting the tens and units portions of said first time period in minutes.

5. A cigarette dispenser in accordance with claim 1 further including display means coupled to said first timing means for indicating when said first time period has elapsed and that said dispenser may be opened without generating said audio signal.

6. A cigarette dispenser in accordance with claim 5 wherein said display means includes a liquid crystal diode.

7. A cigarette dispenser in accordance with claim 5 wherein said display means includes a light emitting diode.

8. A cigarette dispenser in accordance with claim 1 further including second timer means coupled to said alarm means for initiating the countdown of a second time period following activation of said alarm means for timing the duration of said alarm means.

9. A cigarette dispenser in accordance with claim 1 further including third timer means coupled to said latch means and to said alarm means for initiating the countdown of a third time period following the opening of said latch means and for actuating said alarm means if said latch means is not closed within said third time period.

10. A cigarette dispenser in accordance with claim 1 further including a battery for energizing said latch means, said alarm means, said first user selectable switch means, said first timer means, and said overrice means.

11. A cigarette dispenser in accordance with claim 1 further including counter means coupled to said alarm means and to said latch means for counting the number of times said latch means is opened, the number of times said latch means is opened following said first time period, the number of times said latch means is opened without activation of said first timer means and/or prior to the expiration of said first time period and the number of times said latch means is not opened following said first time period.

12. A cigarette dispenser in accordance with claim 11 further including display means and logic and display driver mean coupling said counter means to said display means for displaying said numbers thereon.

13. A cigarette dispenser in accordance with claim 1 further including audio signal generation means coupled to said first switch means and to said alarm means for generating an audio warning following engagement of said first switch means.

14. A cigarette dispenser in accordance with claim 13 wherein said signal generation means includes a voice synthesizer device.

15. A cigarette dispenser in accordance with claim 13 wherein said signal generation means includes an audio recording device.

* * * * *